United States Patent [19]

Toivo

[11] 4,321,879

[45] Mar. 30, 1982

[54] FURNACE FOR CONSUMING SOLID FUEL

[76] Inventor: Auvo A. S. Toivo, Nahkurinkatu 3 A 27, 08100 Lohja 10, Finland

[21] Appl. No.: 46,929

[22] Filed: Jun. 8, 1979

[30] Foreign Application Priority Data

Jun. 12, 1978 [FI] Finland ..... 791776

[51] Int. Cl.[3] ..... F23K 3/00; F24B 7/00

[52] U.S. Cl. ..... 110/267; 237/51; 126/121; 126/143

[58] Field of Search ..... 110/101 R, 267; 126/121, 143; 237/51

[56] References Cited

U.S. PATENT DOCUMENTS

| | | | |
|---|---|---|---|
| 2,131,499 | 9/1938 | Cruse | 110/101 R |
| 2,322,016 | 6/1943 | Hardeman | 126/121 |
| 2,375,318 | 5/1945 | Mudgett | 126/121 |
| 2,399,871 | 5/1946 | Johansson | 122/33 |
| 3,001,521 | 9/1961 | Reilly | 237/51 |
| 3,232,254 | 2/1966 | Rivers | 110/101 R |
| 3,942,509 | 3/1976 | Sasser | 237/51 |
| 4,060,196 | 11/1977 | Goldsby et al. | 237/51 |
| 4,096,849 | 6/1978 | Moncrieff-Yeates | 126/143 |
| 4,183,347 | 1/1980 | Newswanger | 237/51 |
| 4,186,719 | 2/1980 | Dalsin | 126/143 |
| 4,204,519 | 5/1980 | Towery | 237/51 |

FOREIGN PATENT DOCUMENTS

| | | | |
|---|---|---|---|
| 2270527 | 12/1975 | France | 126/143 |
| 2273238 | 12/1975 | France | 126/143 |
| 868337 | 5/1961 | United Kingdom | 237/51 |
| 872434 | 7/1961 | United Kingdom | 126/143 |

*Primary Examiner*—Henry C. Yuen

*Attorney, Agent, or Firm*—McAulay, Fields, Fisher, Goldstein & Nissen

[57] ABSTRACT

A furnace for consuming solid fuel, wherein a horizontal or slanting feeding plane is used to feed fuel into the fire chamber. The feeding plane is attached to a vertical or nearly vertical channel surface, against which the fuel is pressed either with special feeding apparatus or by utilizing the force of gravity. Primary air is led into the lower part of a channel surface after which it rises further upwards along passages formed between the channel surface and the layer of fuel. Secondary air openings are provided on the upper part of the channel surface so that secondary air can be led up from behind the channel surface and through the channel surface onto its front side.

13 Claims, 4 Drawing Figures

26
22
7
21
4
23
6
25
24
5
27
8

FURNACE FOR CONSUMING SOLID FUEL

The invention relates to a furnace for consuming solid fuel, wherein a horizontal or an inclined feeding plane is used to feed the fuel into the fire chamber. The invention is primarily meant to be used in heating systems with natural draught, but it may also be applied to heating systems using articial draught. The furnace according to the invention operates with all kinds of solid fuel, firewood, chips, splinters of wood, peat, straw, and the like.

Two basic methods are known for consuming solid fuel: one is burning from above and the other is burning from below. Burning from above means burning which occurs all through the layer of fuel and on its upper surface. In a kettle using burning from above, the tightness of the filling determines the size of the chimney and the amount of draught which is needed. In such a kettle, therefore, it is not normally possible to burn a thick layer of fuel consisting of small bits. When this is done, a great deal of unburned fuel often gets ash. In addition, smaller bits of the fuel tend to fall through the grates and get lost in the ash. The relatively soft layer of embers on the grates must bear the weight of the fuel on top of it, which often results in the embers falling amid the ashes as well.

In a kettle using burning from above, the burning process consists of various stages. The first stage is a drying stage, where the dampness contained in the fuel is separated and gets mixed up with the powerfully burning gases. The volume of the amount of gases as a whole consequently increases. The chimney does not work properly, because the chimney gases are damp and there is also a great deal of them in the chimney. This results in the kettle getting dirty. Besides, the steam which is separated lowers the burning temperature and makes the burning more difficult in other ways as well. The burning process is therefore unstable, with the flames flaring up and then settling down again, and sometimes there is burning even in the chimney itself.

The tarry substances separated from the substance to be consumed do not burn properly and they are quickly condensed on the walls of the kettle, forming layers of pitch. After the fuel has dried, its temperature can rise. At the same time, the burning process has normally reached the whole of the fuel. Burning continues in the dried fuel in a smouldering form, despite limitations in the amount of air brought in to further the burning. The larger the amount of filling, the more difficult it is to control this phenomenon.

As the burning process reaches its final stage, the amount of gas has diminished considerably. The gases are now dry and emit heat poorly in the now wider kettle. It is difficult to conduct secondary air, because the area of the filling is wide, and the air damper in the upper shutter, for example, is unable to conduct in a desired way the necessary secondary air over the burning substance as a whole. This is impossible even in the immediate neighbourhood of the damper, as the cold and plentiful secondary air often comes to delay the process of burning. Regulating the burning by way of regulating the amount of air does result in diminished power, but the amount of emitted unburned carbon monoxide gas increases at the same time beyond control. Consequently, the actual effect coefficient is very low with partial power.

Burning from below involves a procedure, where the fuel is inserted in a vertical silo or other such storage. The burning occurs on the lower surface of the fuel and new fuel is fed in from the silo as the burning progresses.

A kettle using burning from below is not without faults, either. When the fuel is inserted in the fuel supply, the dampness thereby separated necessarily goes out through the reverbaratory furnace and is mixed up with the flame burning in the pit. In this type of kettle as well, the quality of of the fuel determines the height of the chimney. Thus a structurally narrow pit is often inconvenient, as it regulates the thickness of the layer of the fuel at the same time as it brings the emitting steam into contact with the burning flames. With a narrow pit, therefore, the demand for draught can be decreased, but the burning becomes difficult in other ways.

A wide surface of grates has been used to diminish the effect of the steam emitted from the fuel on the progress of burning, as the dampness emitted from the fuel also tends to extend itself under the surface of the grates. At the same time, a wide surface of grates allows more fuel to get mixed up in the ashpit. Diminishing the surface of the grate leads to decreased power, as the coal in the pit is not alone able to generate the entire power.

It is also well-known that magazine stoves are susceptible to corrosion. This is due to the fact that the burning finds its way to the magazine on top of the grate surface, generating acetic acid as the burning gets more difficult. The hot gases rise up in the magazine space despite the draught in the chimney, because the rate of the flowing is not sufficiently high near the grates to prevent the burning from extending itself in the wrong places. This error in the burning technique can be diminished by building the magazine space of a material able to withstand corrosion.

Even with improved material, the kettles using burning from below are characterized by unburned gases liable to get into the fuel supply. Resulting in an obvious danger of explosion as more fuel is fed in. This is so particularly when the draught damper gets shut and there is no longer draught in the kettle. The burning generates carbon monoxide gas, which rises hot in the fuel supply.

When the fuel comes to an end, the burning extends itself in the magazine and is unvoluntarily increased. As the chimney is normally rather high, a great deal of air flows through the kettle when the fuel has been consumed, cooling the kettle. The kettle is characterized by a poor effect coefficient in normal use. On the other hand, the burning tests have been carried out with full-scale fuel supplies so that the disadvantages of periodical heating have not appeared.

The present invention aims at overcoming the above-mentioned disadvantages. This is achieved with the aid of the furnace according to the invention, characterized by attaching the feeding plane into a vertical or nearly vertical channel surface, on which the fuel is pressed either with special feeding apparatus or by utilizing gravity.

The furnace according to the invention has several advantages as compared to the kettles known hitherto. In the furnace according to the invention the burning occurs in a high and narrow, ribbon-like belt. In this way, the process of burning and its intensity are more easily controlled and regulated. The range of carbon monoxide emitted from the fuel during the burning is even and distributed on a relatively narrow area. The carbon monoxide rises straight up and does not get into the feeding channel of the fuel, which makes it possible to burn it efficiently out above the layer of fuel itself.

The total amount of embers is relatively small, so that it can be easily controlled. Because the layer of embers is very high, however, the temperature rises sufficiently so that all the gasifiable substances appear in gasiform, which results in purer burning. The embers are also thoroughly burned out, because the split-offs fall down gradually and are nearly burned out before they reach the ashpit below the channel.

Heat from the ember is directed towards the direction from where the fuel is supplied and dries the fuel well before it reaches the burning belts. All dampness which is thereby emitted rises vertically up and does not to any considerable degree get mixed up with the flames themselves and disturb the burning process.

According to one profitable embodiment of the invention, it is profitable to conduct secondary air up from behind the channel surface, through the channel surface on its front side. To reach this, the doors for secondary air have been set in the upper part of the channel surface. This arrangement has the advantage of making the secondary air mix up efficiently with the flow of gas rising upwards, thereby achieving complete burning. In addition, the secondary air itself warms up behind the channel surface, while it cools the channel surface.

In the following, the invention and other advantages to be gained by it are explained in detail, with reference to the accompanying drawings.

Figure 1:
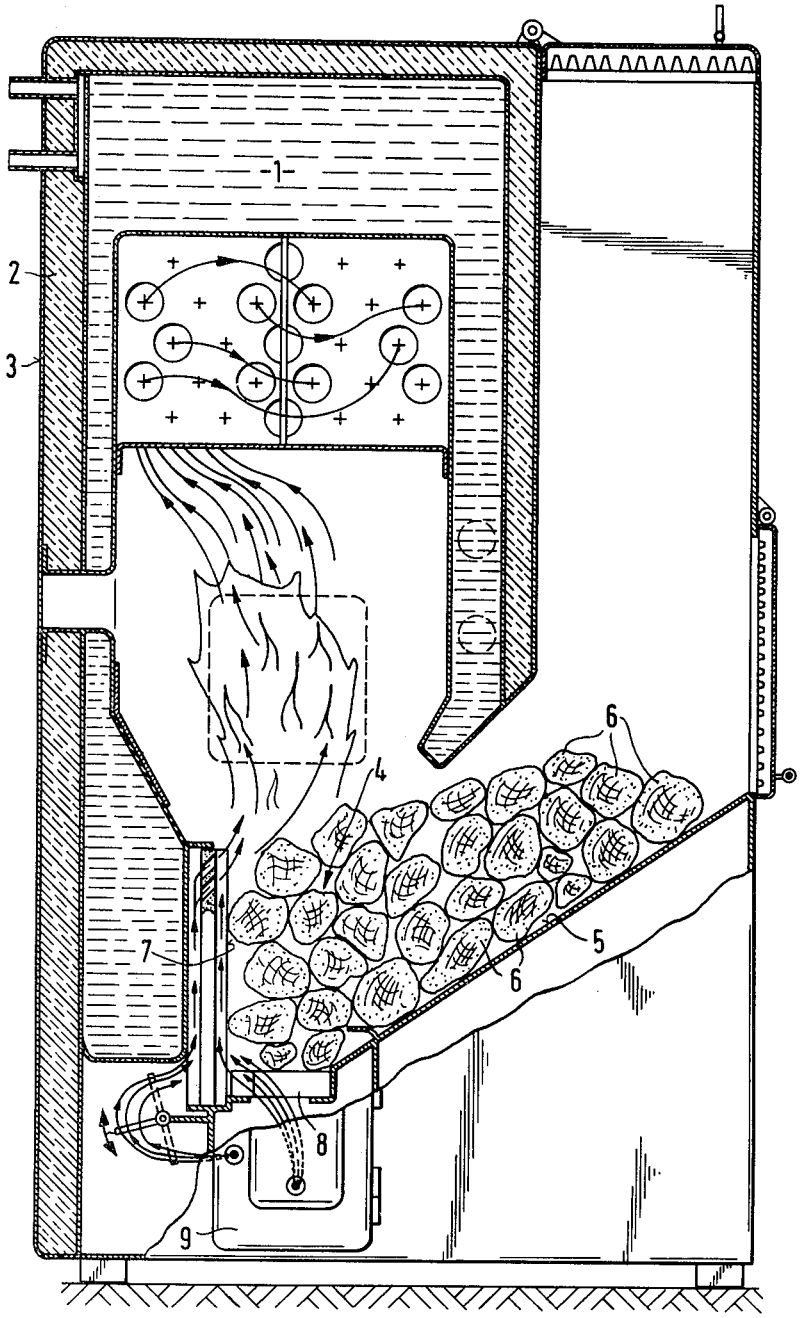
FIG. 1 represents a section of a kettle with a furnace as indicated in the invention.

The kettle represented in FIG. 1 includes a water chamber 1, isolated in the normal way with heat insulation 2, and covered with an outer jacket 3. In the lower part of the kettle is built a furnace, generally indicated by reference number 4. A slanting feeding plane 5 leads to the furnace. On top of the feeding plane 5 lies the fuel 6, made to glide down the feeding plane 5 by the force of gravity. Gravitation action presses the fuel against the vertical channel surface 7. The lower end of the feeding plane 5 includes a grate-like section 8, through which primary air partly flows to reach the space between channel surface 7 and the layer of fuel 6. Combustion air is led into the kettle through door 9.

Figure 2:
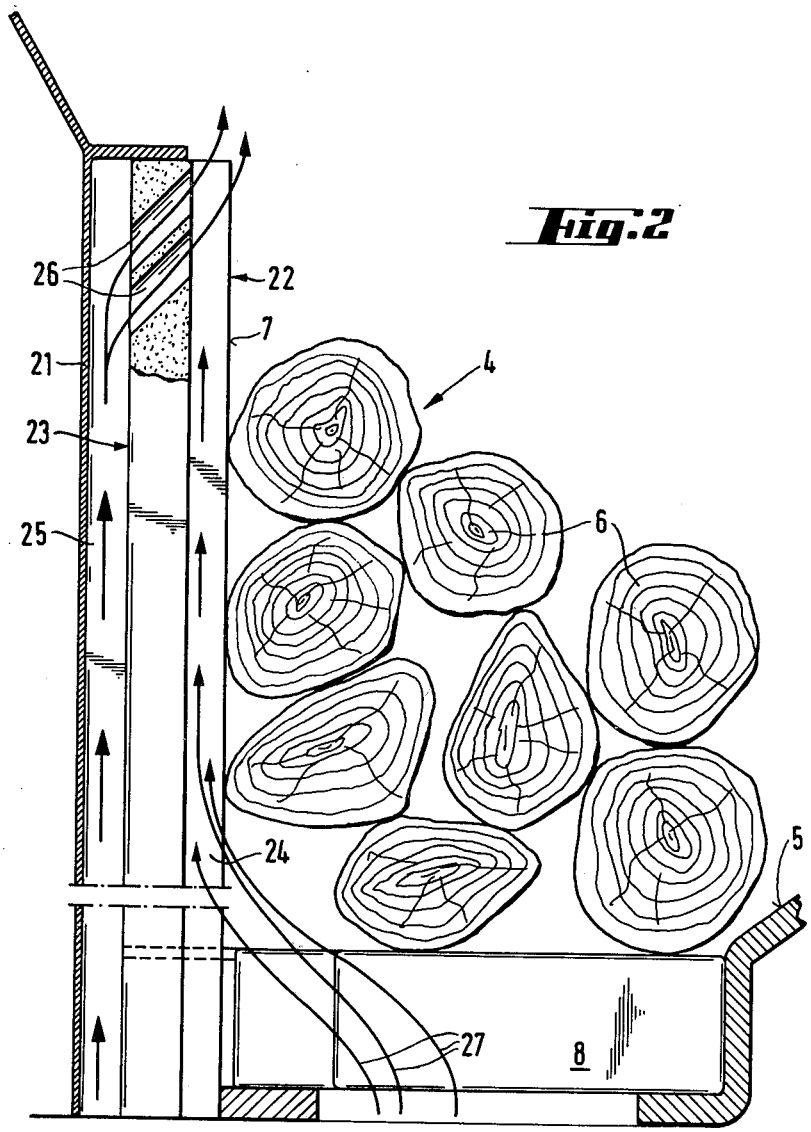
FIG. 2 represents the furnace on FIG. 1 in a larger scale.
Figure 3:
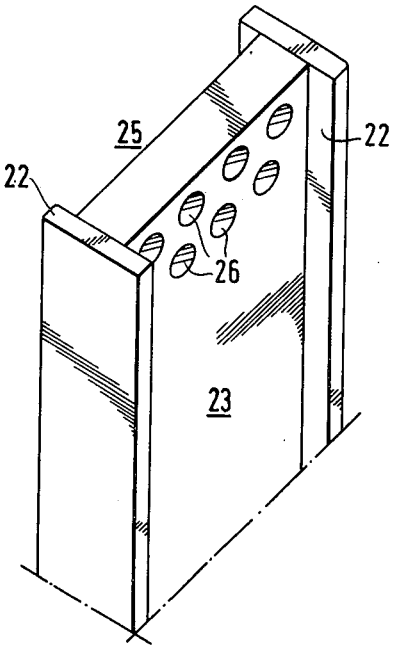
FIGS. 3 and 4 represent the details of the furnace indicated in the invention.

FIG. 2 represents on a larger scale the structure of the furnace 4 indicated in the previous Figure. The channel surface 7 has been constructed by fastening vertical plates 22 on the jacket 21 of the kettle at regular intervals. Between these has been built a wall consisting of thin firebricks 23. The structure of the wall is represented more in detail in FIGS. 3 and 4. The structure in FIG. 3 corresponds to the structure of the furnace represented in FIGS. 1 and 2. Here the plates 22 on either side of each tile stretch out further towards the furnace than the surface of the tiles 23. When fuel is pressed against the surface here decribed, several vertical channels 24 are formed, limited by tiles 23, plates 22 and the layer of fuel 6.

The tiles 23 have been constructed so that a secondary air channel 25 is formed behind them. The secondary air channel 25 is also connected to the front side of the channel surface by way of secondary air doors 26.

A separate grate-like section 8 has been set at the lower end of the feeding plane. This is not a proper grate, as the burning does not really take place upon it. Part of the air needed for the burning process is conducted through section 8, as indicated by arrows 27. The air entrances of section 8 have been made extremely narrow, particularly on their right side (in FIG. 2), so that any burning which may have started on top of section 8 and all carbonization which may have resulted from it stops with ash the above-mentioned air holes, starting from the direction of the fuel feeding, and thereby stops the burning as well.

Figure 4:
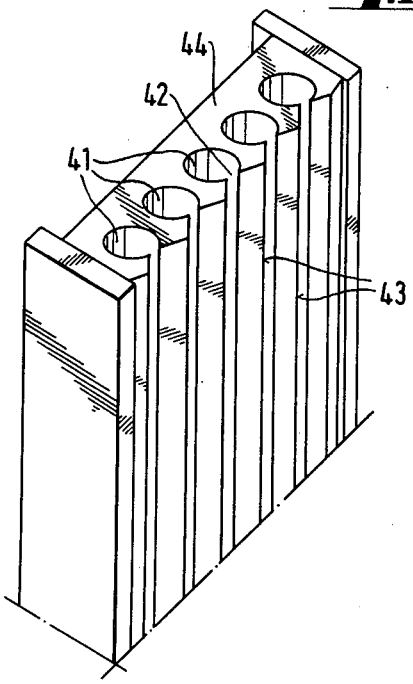

FIG. 4 represents another profitable way of building the channel surface. In this mode of operation, tile 44 is in itself constructed so that it contains several channels 41. The cross surface of each channel 41 may be a near circle, and each channel is connected with the surface through passage 42, whose width is less than the greatest diameter of the passage. This structure is advantageous in burning very finely-grained fuel, such as splinters of wood.

Even other types of passages can be used in a profitable way. In the case represented in FIG. 4, for example, the passages can be U-shaped or rectangular at the bottom. It is also profitable that the ridge between each passage forms a ridge 43 projecting towards the furnace. The depth of the channel surface 24 is normally 1-25 mm, depending on the combustion power. In the furnace indicated in the invention there is no grate in the actual sense, as the fire area is so narrow. The task of the grate-like section 8 at the lower end of the feeding plane is to bear the layer of fuel, conduct it against the channel surface, and distribute primary air between the channel space and the layer of fuel. In practice, the free cross area of the grate-like section 8 is small, and the free area is mainly situated under the channel space. Elsewhere section 8 is tighter, so that any escaping fire stops with ash the entrance of air necessary for its continuation.

The fuel glides down against the channel space from the fuel supply on the other side of the kettle. From this vertical supply the fuel is led through a slanting feeding plane 5 against the channel space. The inclination of the feeding plane 5 may be 40°, or the like, but it is also possible to use mechanical feeding. As the slanting feeding plane presses the fuel tight, it also causes the burning to take place against the channel space.

The furnace according to the invention operates in the following way.

Primary air for the burning process is led through the channel space. Secondary air is led through another channel behind the channel bricks and made to contribute to the burning process in the gas belt rising from the supply. The secondary air simultaneously cools the hot channel bricks and is itself sufficiently hot.

The carbonization and gasification processes take place in the channel space, which is a very narrow area. The height of the burning surface, on the contrary, is considerable, which makes the heat usage in the burning very dense, resulting in a kind of pressure and making the gas belt rising up from the channel hot and free of ungasifiable substances. The embers do not easily fall into the ashpit, as the fuel does not press upon them from on top of them. Embers are "laid on the shelf", as it were, and consumed even further. On the lowest plane the primary air contains most oxygen, and the embers are quickly burnt out.

The layer of embers is narrow, depending on the quality of the fuel. If solid pieces of firewood are used, for example, it will be about 50 mm in width. The width of the layer of embers is easy to control, as heat always rises upwards and it is possible to use a draught regulator, for example, to shut the air damper and make the gases rise upwards, preventing them from turning the fuel into gas as fast as normally happens in other types of kettle. With a small amount of air, the channel space is filled with embers, which increases resistance in the channel space. The current of air can then easily take another channel, the secondary channel, and burn the gas still emitting from the supply.

As the temperature in the channel space is high, it can be assumed that the greater steam pressure in the channel space prevents the steam rising from the fuel from entering the channel space to any considerable degree. The steam rises through its own column on top of the filling. Since gases can rise up and there is no mixing, the burning is probably dryer than in other types of kettle. The burning process, in consequence, is more thorough and also generates tarry substance heat. Practical experiments support this; the kettle has remained considerably clean even in difficult burning conditions.

As the burning zone moves upwards, the drying, gasification and carbonization processes are continuous, leading to an improved final result. The flame burns in a narrow ribbon-like zone on top of the filling, and partly to its side. If secondary air is led towards the root of the flame in narrow showers, for instance through several holes, the burning will be complete.

The arrangement of channel burning has the advantage that burning gases do not rise among the fuel in the kettle. Because hot gases always rise upwards and the fuel forms an obstacle as it glides in from the fuel supply, there is in practice no danger of explosion. At the same time, there is less corrosion in the kettle.

With small-grained fuel, channel tiles are used in the channel, so that the fuel gathers in the opening of each particular channel, inside which the burning process takes place. Not until a piece of firewood has burned small enough is it able to enter through the narrow opening of the channel into the wider space beyond, and to fall into the ashpit. Secondary air is led to the burning process in the same way as with normal tiles. With small-grained fuel, tighter grates are also used.

In the above, the invention has been explained with reference to only a few profitable examples of its putting into practice. The idea is of course in no way to limit the invention to cover only the examples presented above: the invention can be modified in many ways within the following claims. Thus the channel surface can also be put in an oblique position, for example vertical to the feeding plane. This is profitable if straw bales or the like are burned. Fuel can also be fed in with the aid of a special feeding apparatus, in which case the feeding plane can be horizontal or even slant upwards.

What we claim is:

1. A furnace for consuming solid fuel, comprising a fire chamber;

air conduction means proximate to said fire chamber for guiding air to be heated by said fire chamber therepast, said air conduction means including a surface and having an opening adjacent to said fire chamber;

inclined feed means associated with said air conduction means including a feeding channel for feeding fuel into said fire chamber and causing a layer of the fuel to be pressed against said surface so that the burning is even and distributed with carbon monoxide rising staight up and away through said air conduction means away from the feeding channel of the fuel;

said air conduction means includes a first air channel having said opening facing said fire chamber with said surface against which the fuel is pressed by said inclined feed means, and a second air channel facing away from said fire chamber with said surface adjacent said inclined feed means and, said first air channel extending for the length of said air conduction means so that primary air is led into said first channel at a lower part of said air conduction means, and said second air channel provides for the passage of secondary air adjacent to the primary air; and air doors connecting said first and said second air channels for leading the secondary air from said second air channel after traversal thereof to said first air channel to said surface so that the secondary air mixes with the flow of gases rising upwards to achieve complete burning, the secondary air warms up behind said surface while cooling the part of said surface facing the fuel.

2. A furnace as claimed in claim 1, wherein said first and said second channels each comprise several vertical passages, each said vertical passage having a cross-section which is U-shaped.

3. A furnace as claimed in claim 1, wherein said first channel comprises several vertical channelways and a passage connecting each said channelways to said fire chamber, the cross-section of each of said vertical channelways being nearly a circle and said passage having a width narrower than the largest diameter of the cross-section of said channelways.

4. A furnace according to claim 3, including ridges at said passages between said channelways built to protrude from the plane surface towards said fire chamber.

5. A furnace for consuming solid fuel, comprising:

a fire chamber;

air conduction means proximate to said fire chamber for guiding air to be heated by said fire chamber therepast, said air conduction means including a plane channel surface and having an opening adjacent to said fire chamber; and inclined feed means associated with said air conduction means including a feeding channel for feeding fuel into said fire chamber and causing a layer of the fuel to be pressed against said surface so that the burning is even and distributed with carbon monoxide passing through said opening, rising straight up and away through said air conduction means away from the feeding channel of the fuel;

said air conduction means includes a first air channel having said opening facing said fire chamber with said surface against which the fuel is pressed by said inclined feed means, and said first air channel extending for the length of said air conduction means so that primary air is led into said first channel at a lower part of said air conduction means; and ridges extending from said first air channel which is built to protrude from said plane surface thereof towards said first chamber.

6. A furnace for consuming solid fuel, comprising a fire chamber;

air conduction means proximate to said fire chamber for guiding air to be heated by said fire chamber therepast, said air conduction means including a channel surface adjacent to said fire chamber; and inclined feed means associated with said air conduction means including a feeding channel for feeding fuel into said fire chamber and causing a layer of the fuel to be pressed against said surface so that the burning is even and distributed with carbon monoxide rising straight up and away through said air conduction means away from the feeding channel of the fuel, said inclined feed means including a feeding plane attached to said surface, said feeding plane having openings in the side towards said channel surface so that part of the air is led through said openings between said surface and the layer of fuel pressed against said surface.

7. A furnace for consuming solid fuel, comprising:

a fire chamber;

air conduction means proximate to said fire chamber for guiding air to be heated by said fire chamber therepast, said air conduction means including a surface and having an opening adjacent to said fire chamber; and inclined feed means associated with said air conduction means including a feeding channel for feeding fuel into said fire chamber and causing a layer of the fuel to be pressed against said surface so that the burning is even and distributed with carbon monoxide rising straight up and away through said air conduction means away from the feeding channel of the fuel;

said air conduction means includes a first air channel having said opening facing said fire chamber with said surface against which the fuel is pressed by said inclined feed means, and said first air channel extending for the length of said air conduction means so that primary air is led into said first channel at a lower part of said air conduction means; and a separate grate-like section between said inclined feed means and said air conduction means, said separate section being provided with air openings through which part of the primary air flows upwards into said first air channel between said surface and the fuel.

8. A furnace according to claim 7, including feeding apparatus cooperating with said inclined feed means for pressing the fuel against said surface.

9. A furnace for consuming solid fuel, comprising a fire chamber;

air conduction means proximate to said fire chamber for guiding air to be heated by said fire chamber therepast, said air conduction means including a surface adjacent to said fire chamber; and inclined feed means associated with said air conduction means including a feeding channel for feeding fuel into said fire chamber and causing a layer of the fuel to be pressed against said surface so that the burning is even and distributed with carbon monoxide rising straight up and away through said air conduction means away from the feeding channel of the fuel; and said air conduction means includes:

at least one pair of vertical plates, a wall formed of firebricks connected between each said pair of plates, said wall including said surface facing said fire chamber, the thickness of said wall being less than the width of said plates so that said plates extend closer to said fire chamber than said wall, the fuel cooperating with said wall to form several vertical primary channels facing the fuel defined by said wall, said vertical plates and the fuel, a secondary air channel formed behind said primary air channels between each said pair of vertical plates and the rear of said wall facing away from said fire chamber and said surface, and air doors connecting said secondary air channel with said primary air channels.

10. The furnace as claimed in claim 9, wherein said air conductor means includes at least one pair of vertical plates, and a wall formed of firebricks connected between each said pair of plates, said wall including at least two longitudinal channels each having a passage opening into said fire chamber, the cross-section of each said channel being a near circle.

11. A furnace according to claim 1, wherein said surface is a plane surface, and including ridges extending from said first air channel which is built to protrude from said plane thereof surface towards said first chamber.

12. A furnace according to claim 1 or 5, wherein said inclined feed means includes a feeding plane attached to said surface, said feeding plane having openings in the side towards said channel surface so that part of the primary air is led through said openings between said surface and the layer of fuel pressed against said surface.

13. A furnace according to claim 1, 5 or 6, including a separate grate-like section between said inclined feed means and said air conduction means, said separate section being provided with air openings through which part of the primary air flows upwards into said first air channel between said surface and the fuel.

* * * * *